US006224465B1

(12) United States Patent
Meyer

(10) Patent No.: US 6,224,465 B1
(45) **Date of Patent: *May 1, 2001**

(54) METHODS AND APPARATUS FOR CHEMICAL MECHANICAL PLANARIZATION USING A MICROREPLICATED SURFACE

(76) Inventor: Stuart L. Meyer, 7617 N. Eastlake Ter., Unit F, Chicago, IL (US) 60626-1492

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/883,404

(22) Filed: Jun. 26, 1997

(51) Int. Cl.[7] ..... B24B 1/00

(52) U.S. Cl. ..... 451/41; 451/56; 451/57; 451/59

(58) Field of Search ..... 451/36, 37, 41, 451/57, 530, 285, 287, 288, 42, 56, 59, 63, 286, 290, 305, 306, 307, 527, 529, 550

(56) References Cited

U.S. PATENT DOCUMENTS

| | | | | |
|---|---|---|---|---|
| 5,152,917 | * | 10/1992 | Pieper et al. | 51/295 |
| 5,667,541 | * | 9/1997 | Klun et al. | 51/298 |
| 5,672,097 | * | 9/1997 | Hoopman | 451/526 |
| 5,961,372 | * | 10/1999 | Shendon | 451/41 |

FOREIGN PATENT DOCUMENTS

| | | | | |
|---|---|---|---|---|
| 0 348 757 | * | 6/1989 | (EP) | 21/306 |

* cited by examiner

*Primary Examiner*—Timothy V. Eley
(74) *Attorney, Agent, or Firm*—Snell & Wilmer, L.L.P.

(57) ABSTRACT

A chemical mechanical planarization process employs a microreplicated surface comprising a regular array of precisely shaped three-dimensional structures such as pyramids, cones, or cube-corners. In a preferred embodiment, asperities of the microreplicated surface employed in an advancing linear belt are allowed to ablate during processing, effectively resulting in a two-phase grinding/polishing operation that increases the material removal rate and increases workplace throughput.

19 Claims, 8 Drawing Sheets

METHODS AND APPARATUS FOR CHEMICAL MECHANICAL PLANARIZATION USING A MICROREPLICATED SURFACE

TECHNICAL FIELD

The present invention relates, generally, to the configuration of the surface topography of pads used in processing workpieces and, more particularly, to the use of microreplicated structures as a pad surface topography.

BACKGROUND ART AND TECHNICAL PROBLEMS

Chemical mechanical planarization ("CMP") is widely used in the microelectronics industry, particularly for local and global planarization of VLSI devices with sub-micron geometries. A typical CMP process involves polishing back built-up layers of dielectrics and conductors on integrated circuit chips during manufacture.

More particularly, a resinous polishing pad having a cellular structure is traditionally employed in conjunction with a slurry, for example a water-based slurry comprising colloidal silica particles. When pressure is applied between the polishing pad and the workpiece (e.g., silicon wafer) being polished, mechanical stresses are concentrated on the exposed edges of the adjoining cells in the cellular pad. Abrasive particles within the slurry concentrated on these edges tend to create zones of localized stress at the workpiece in the vicinity of the exposed edges of the polishing pad. This localized pressure creates mechanical strain on the chemical bonds comprising the surface being polished, rendering the chemical bonds more susceptible to chemical attack or corrosion (e.g., stress corrosion). Consequently, microscopic regions are removed from the surface being polished, enhancing planarity of the polished surface. See, for example, Arai, et al., U.S. Pat. No. 5,099,614, issued March, 1992; Karlsrud, U.S. Pat. No. 5,498,196, issued March, 1996; Arai, et al., U.S. Pat. No. 4,805,348, issued February, 1989; Karlsrud et al., U.S. Pat. No. 5,329,732, issued July, 1994; and Karlsrud et al., U.S. Pat. No. 5,498,199, issued March, 1996, for further discussion of presently known lapping and planarization techniques. By this reference, the entire disclosures of the foregoing patents are hereby incorporated herein.

Presently known polishing techniques are unsatisfactory in several regards. For example, as the size of microelectronic structures used in integrated circuits decreases to sub-half-micron levels, and as the number of microelectronic structures on current and future generation integrated circuits increases, the degree of planarity required increases dramatically. The high degree of accuracy of current lithographic techniques for smaller devices requires increasingly flatter surfaces. Presently known polishing techniques are believed to be inadequate to produce the degree of local planarity and global uniformity across the relatively large surfaces of silicon wafers used in integrated circuits, particularly for future generations.

Presently known polishing techniques are also unsatisfactory in that processes designed to produce planar, defect-free surfaces are necessarily time-consuming—involving extremely fine slurry particles in conjunction with porous pads.

Presently known polishing techniques are also unsatisfactory in that traditional polishing pads require periodic conditioning to maintain their effectiveness. As a result, batch-to-batch variations persist, and other complications of the conditioning step arise (for example, degradation of the conditioning pad itself).

Microreplicated structures are generally well known in other fields, particularly in the field of optics, where—as a result of their retroreflective properties—microreplicated films have found wide application for use in Fresnel lenses, road signs and reflectors. In addition, larger examples of such structures (on the order of 100 microns in height) have been incorporated into structured abrasive articles useful for grinding steel and other metals (see, e.g., Pieper et al., U.S. Pat. No. 5,304,223, issued Apr. 19, 1994).

In the context of chemical-mechanical planarization, regular arrays of structures (e.g., hemispheres, cubes, cylinders, and hexagons) have been formed in standard polyurethane polishing pads (see e.g. , Yu et al., U.S. Pat. No. 5,441,598, issued Aug. 15, 1995). Such structures are typically over 250 microns in height, and—due to their porosity—suffer from the same asperity variations found in other polyurethane pads.

Chemical mechanical planarization techniques and materials are thus needed which will permit a higher degree of planarization and uniformity of that planarization over the entire surface of integrated circuit structures. At the same time, more efficient techniques are needed to increase the throughput of wafers through the CMP system while reducing batch-to-batch variation.

SUMMARY OF THE INVENTION

In accordance with a preferred embodiment of the present invention, a chemical mechanical planarization process employs a microreplicated surface or pad in lieu of the traditional cellular polishing pad employed in presently known CMP processes. For example, a microreplicated surface useful in the context of the present invention suitably consists of a regular array of precisely shaped three-dimensional structures (for example, pyramids), each of which preferably have sharp distal points. The uniformity of such a microreplicated surface provides enhanced global and local planarization. Such microreplicated pads further provide improved processing of other types of workpieces, including magnetic media, magnetoresistive (MR) heads, texturizing of pre and post-media disks, and polishing of glass and metallic media. These pads further provide a technique for planarizing workpieces with photoresist build-up along their perimeters.

In a preferred embodiment, wherein slurry particles are substantially smaller than the microreplicated structure size, chemical mechanical polishing takes place in two phases. Early on in the process, when the microreplicated surface is fresh and its asperities are relatively sharp, material removal at the workpiece surface is effected primarily through mechanical abrasion between the workpiece and the microreplicated structures. During this phase, abrasive particles in the slurry have little effect on material removal rate. As processing progresses, however, and ablation of the microreplicated polishing surface proceeds, the individual microreplicated structures become dulled. As dulling of the microreplicated structures continues, the chemical-mechanical effects of the abrasive particles become more pronounced. In view of the transitional nature of this process, a microreplicated surface is advantageously employed in a linear belt configuration, wherein the belt moves either continuously or, in a particularly preferred embodiment, advances linearly at the beginning of the process (at the completion of the previous batch of workpieces) in order to provide a fresh microreplicated surface. This ensures repeatable polishing conditions, and reduces batch-to-batch variation.

In accordance with a further aspect of the present invention, the use of a microreplicated pad in a consolidated two-phase process increases workpiece throughput by providing a high initial removal rate at the beginning of the polishing operation (when the microreplicated structures are sharp), followed gradually by a fine polishing step (as the microreplicated structures become dull).

BRIEF DESCRIPTION OF THE DRAWING FIGURES

The subject invention will hereinafter be described in conjunction with the appended drawing figures, wherein like numerals designate like elements, and:

FIG. 3(*b*) is a schematic representation of the structure of FIG. 3(*a*) upon completion of a presently known polishing process, illustrating localized non-planarity;

FIG. 4(*b*) is an exemplary triangle-base pyramid structure;

FIG. 4(*c*) is an exemplary cone structure;

FIG. 4(*d*) is an exemplary cube-corner element;

FIG. 7(*b*) is a schematic cross-section view of the structure of FIG. 7(*a*) after first-phase grinding with sharp microreplicated structures, illustrating localized non-planarity;

FIG. 7(*c*) is a schematic cross-section view of the structure of FIG. 7(*b*), shown in conjunction with a partially-ablated microreplicated pad in accordance with a preferred embodiment of the present invention;

FIG. 7(*d*) is a schematic cross-section view of the structure of FIG. 7(*c*) illustrating the enhanced planarity achievable after second-phase polishing with the partially-ablated microreplicated pad.

DETAILED DESCRIPTION OF PREFERRED EXEMPLARY EMBODIMENTS

Figure 1:
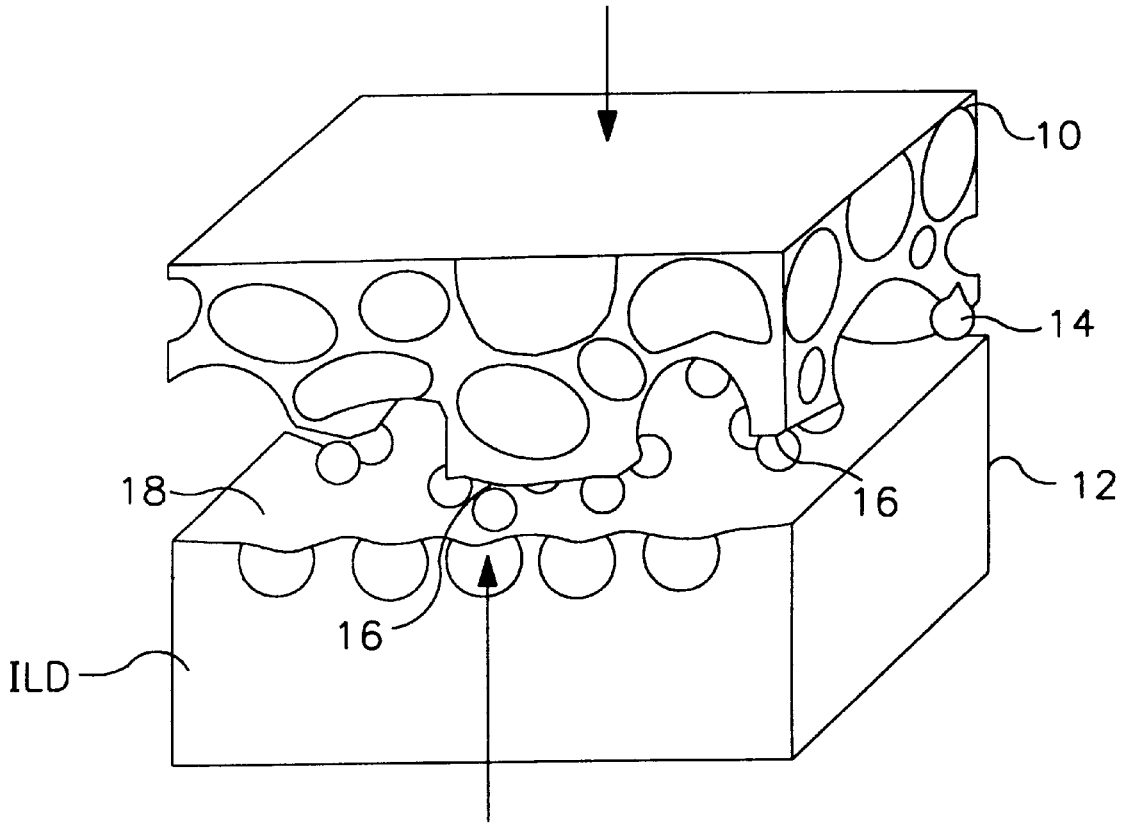
FIG. 1 is a schematic diagram of an exemplary foam polishing pad operating on an exemplary silicon workpiece in an abrasive slurry environment.

Referring now to FIG. 1, presently known CMP processes typically employ a rigid foam polishing pad 10 to polish the surface of a workpiece 12, for example an integrated circuit layer. An abrasive slurry comprising a plurality of abrasive particles 14 in an aqueous medium is employed at the interface between the pad surface and workpiece surface. Cellular pad 10 comprises a large number of randomly distributed open cells or bubbles, with exposed, irregularly shaped edges forming the junction between cells. Those edge surfaces 16 which come into contact with surface 18 of workpiece 12 are known as asperities, and support the load applied to pad 10 which results in frictional forces between pad 10 and workpiece 12 as pad 10 is moved laterally (e.g., in a circular planetary or linear manner) with respect to workpiece 12 during the polishing process.

With continued reference to FIG. 1, abrasive particles 14 within the slurry are urged onto surface 18 of workpiece 12 by asperities 16, creating high stress concentrations at the contact regions between asperities 16 and surface 18. Thus, FIG. 1 illustrates some of the principle mechanical phenomena associated with known CMP processes.

Figure 2:
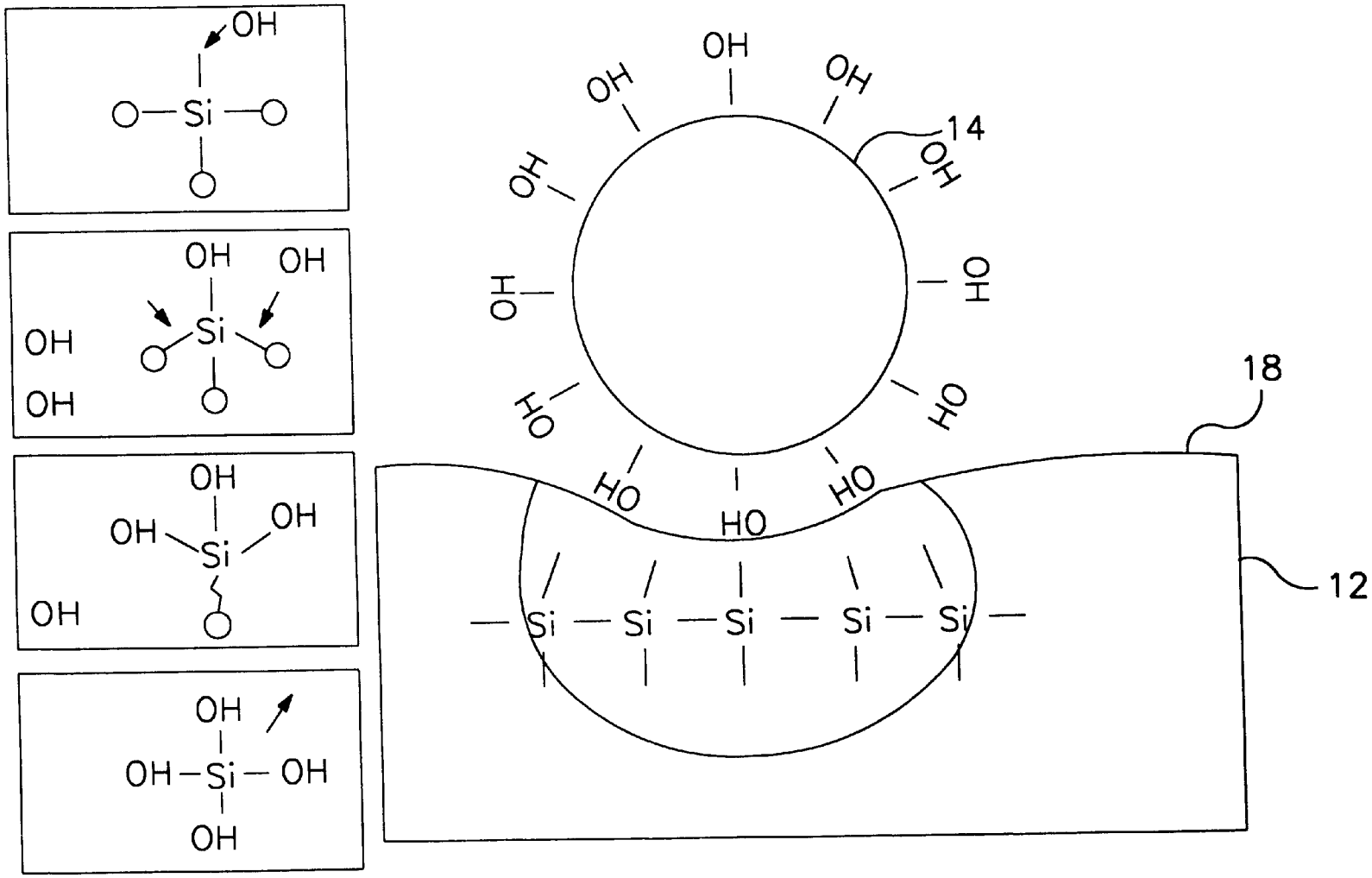
FIG. 2 is a concept diagram illustrating chemical aspects of a traditional chemical mechanical planarization process.

Referring now to FIGS. 1 and 2, some of the principle chemical phenomena associated with known CMP techniques are illustrated. For example, in the case of polishing silicon dioxide interlayer dielectrics, when a compressive force is applied to surface 18 of workpiece 12 by the pad 10, the chemical bonds which make up the structure of that layer of workpiece 12 in contact with pad 10 become mechanically stressed. The mechanical stress applied to these chemical bonds and their resultant strain increases the affinity of these bonds for hydroxide groups which are attached to abrasive particle 14. When the chemical bonds which comprise surface 18 of workpiece 12 are broken, silanols are liberated from surface 18 and carried away by the slurry. The liberation of these surface compounds facilitates the creation of a smooth, flat, highly planar surface 18.

In the context of a preferred embodiment of the present invention, a slurry is used to effect chemical/mechanical polishing and planarization. More particularly, in the context of the present invention a "slurry" suitably comprises a chemically and mechanically active solution, for example including abrasive particles coupled with chemically reactive agents. Suitable chemically reactive agents include hydroxides, but may also include highly basic or highly acidic ions. Suitable agents (e.g., hydroxides) are advantageously coupled to the abrasive particles within the slurry solution. In the context of a preferred embodiment suitable abrasive particles within the slurry may be on the order of 10–1000 nanometers in size in the source (dry) state. This is in contrast to traditional lapping solutions, which may include abrasives having sizes in the range of 0.5–100 micrometers. Suitable slurries in the context of the present invention may also include oxidizing agents (e.g., potassium fluoride), for example in a concentration on the order of 5–20% by weight particle density.

Figure 3A:
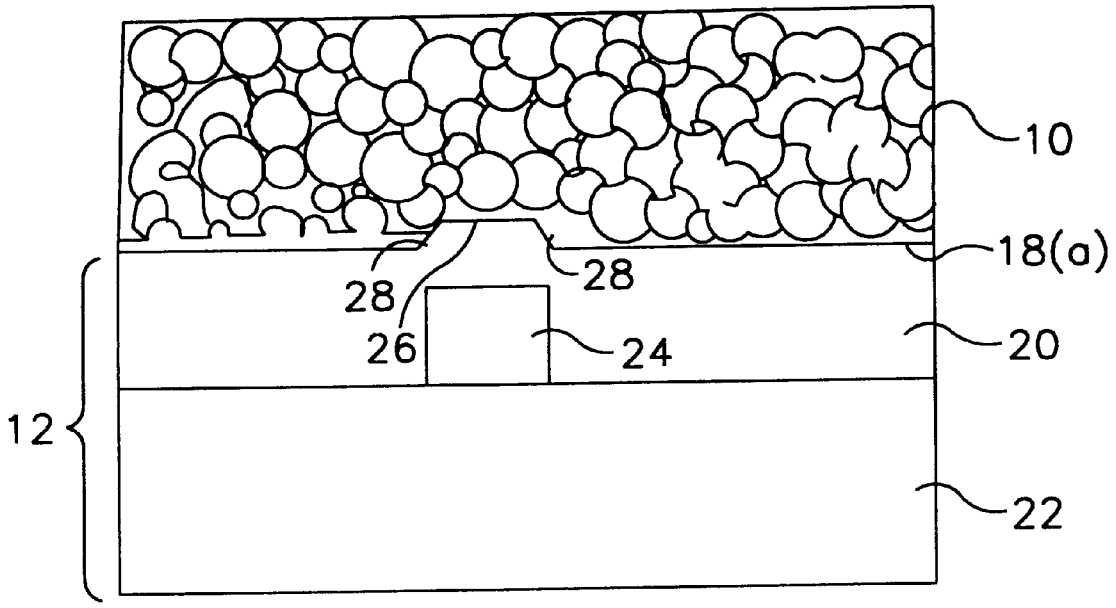
FIG. 3(*a*) is a schematic cross-section view of an exemplary section of an integrated circuit shown in conjunction with a presently known polishing pad.
Figure 3B:
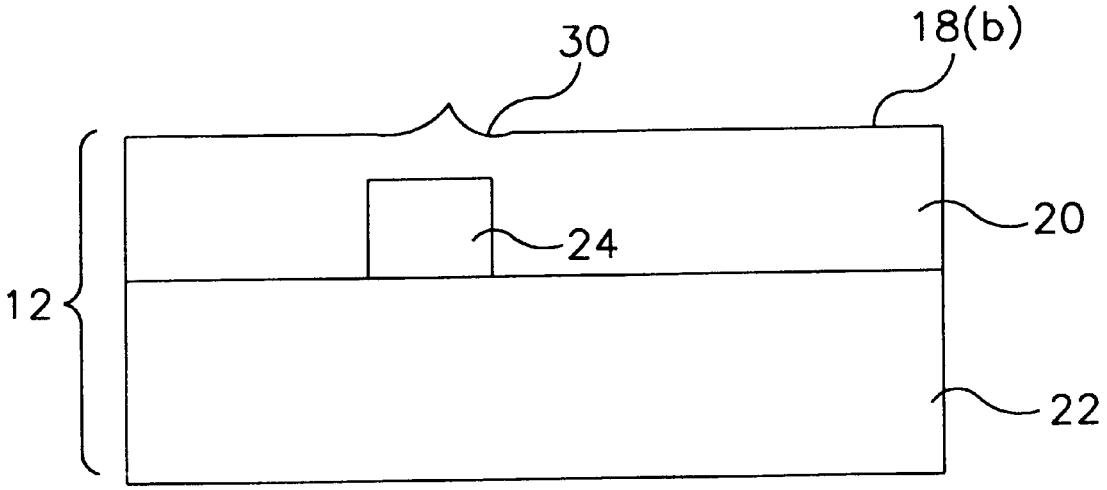
Figure 4A:
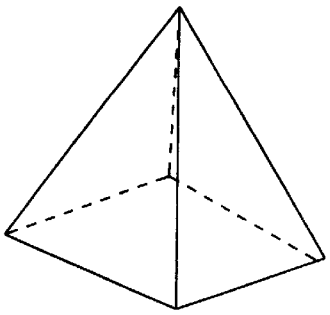
FIG. 4(*a*) is an exemplary square-base pyramid structure.
Figure 4B:
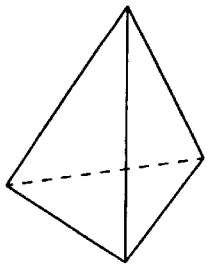
Figure 4C:
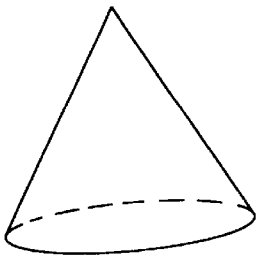
Figure 4D:
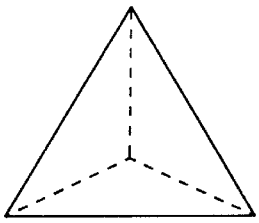

Referring now to FIG. 3(*a*), an exemplary workpiece 12 suitably comprises a silicon layer 22 having microelectronic structures 24 disposed thereon (or therein). In accordance with the illustrated embodiment, microstructures 24 may comprise conductors, via holes, or the like, in the context of an integrated circuit. Workpiece 12 further comprises a dielectric layer 20 applied to the surface of silicon layer 22, which dielectric layer may function as an insulator between successive silicon layers in a multiple-layered integrated circuit.

During the semiconductor manufacturing process, dielectric 20 is placed over silicon layer 22 (and its associated electronic microstructures) in such a way that localized device topographies (e.g., ridges) 26 are formed in the dielectric layer corresponding to microstructures 24. It is these ridges, inter alia, which need to be eliminated during the CMP process to form an ideally uniform, flat, planar surface upon completion of the CMP process. However, as is known in the art, present CMP techniques are not always capable of producing a sufficiently flat, planar surface, particularly for small device lithography, for example in the submicron range.

Referring now to FIGS. 3(*a*) and 3(*b*), the asperities (e.g., projections) associated with the surface of polishing pad 10 contact dielectric surface 18(*a*) as workpiece 12 and pad 10 are moved relative to one another during the polishing process. A chemically and mechanically active slurry or other suitable solution (not shown in FIGS. 3(*a*) and 3(*b*)) is provided between the mating surfaces of workpiece 12 and pad 10 to facilitate the polishing process. As pad 10 moves relative to workpiece 12, the asperities associated with pad 10, in conjunction with the abrasive particles comprising the slurry, polish down device topographies (ridges) 26, removing material from the ridges in accordance with the chemical and mechanical phenomena associated with the CMP process described above. In particular, the irregular edges which form the surfaces adjoining the cells of pad 10 tend to deflect or bend as they encounter respective leading edges 28 of ridges 26, trapping abrasive particles between the asperities associated with pad 10 and the edges of respective device topographies 26, wearing down respective edges 28 at a faster rate than the device topography surfaces. During the course of the polishing process, ridges 26 are typically worn down until they are substantially co-planar with surface 18(*a*); however, it is known that this planarization process is incomplete. Hence, residual nodes or undulations 30 typically remain proximate microstructures 24 upon completion of the planarization process. Although surface 18(*b*) associated with workpiece 12 is certainly more highly planar upon completion of the CMP process than the surface 18(*a*) associated with workpiece 12 prior to completion of the planarization process, the existence of nodules can nonetheless be problematic, particularly in future generation integrated circuits wherein extremely high degrees of planarity are desired.

In accordance with the present invention, a microreplicated pad is suitably employed in a CMP process in lieu of cellular polishing pad. The microreplicated pad has a microreplicated surface featuring a regular array of precisely-shaped three-dimensional structures. Referring now to FIGS. 4(*a*)–4(*d*), such structures might, for example, include square-base pyramids (FIG. 4(*a*)), triangle-base pyramids (FIG. 4(*b*)), cones (FIG. 4(*c*)), or "cube-corner" elements. A cube-corner element has the shape of a trihedral prism with three exposed faces, and is generally configured so that the apex of the prism is vertically aligned with the center of the base, but may also be configured such that the apex is aligned with a vertex of the base (FIG. 4(*d*)).

Figure 5:
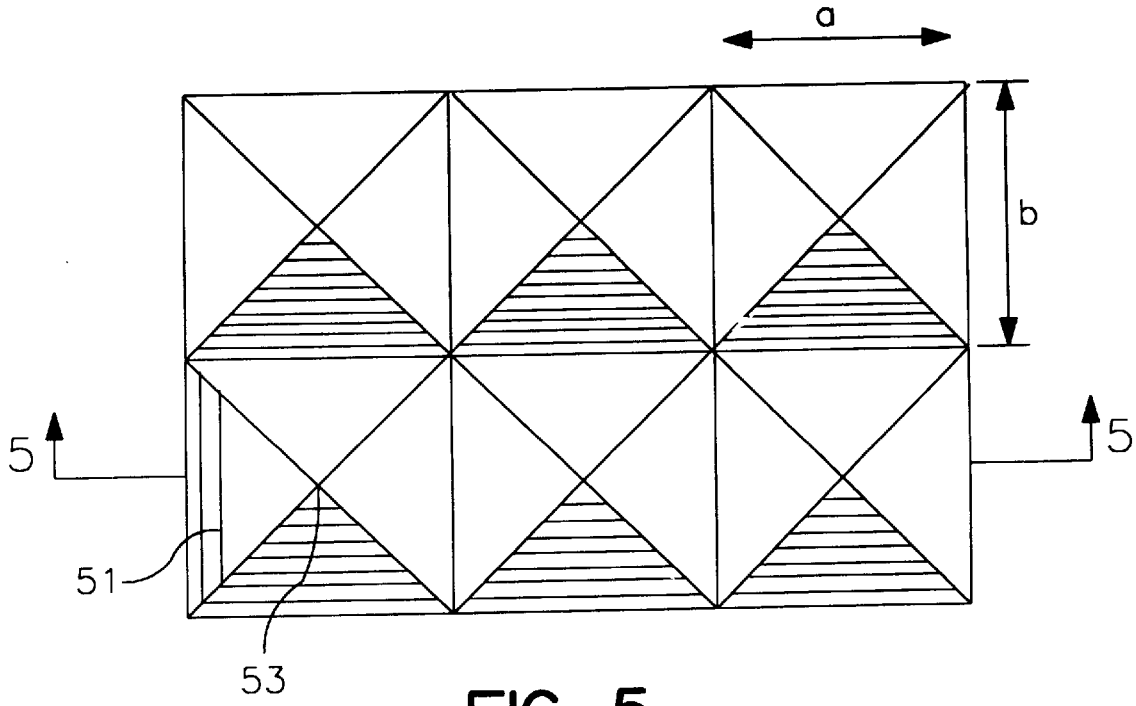
FIG. 5 is a close-up top view of an exemplary microreplicated surface utilizing square-base regular pyramids.
Figure 6:
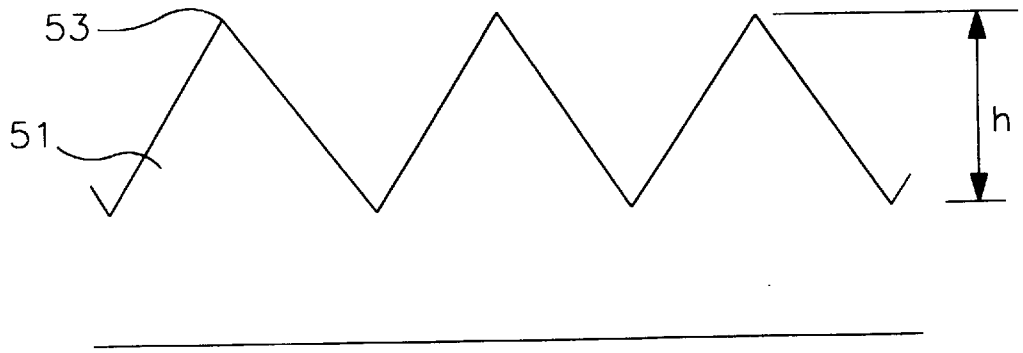
FIG. 6 is a side view of the exemplary microreplicated surface shown in FIG. 5.
Figure 7A:
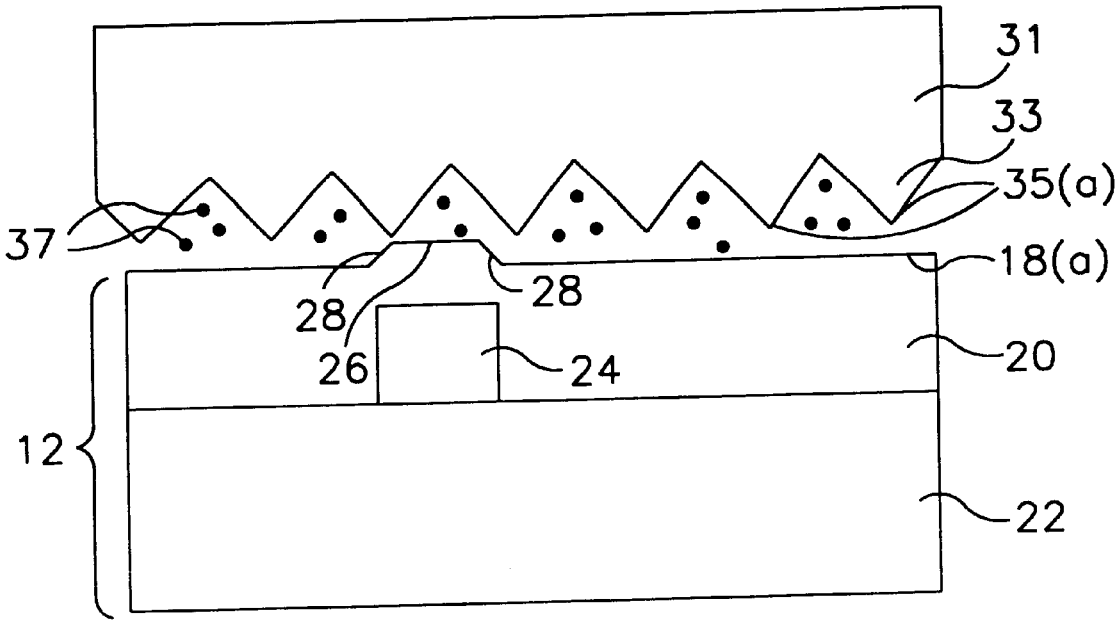
FIG. 7(*a*) is a schematic cross-section view of an exemplary section of an integrated circuit shown in conjunction with a microreplicated pad in accordance with a preferred embodiment of the present invention.
Figure 7B:
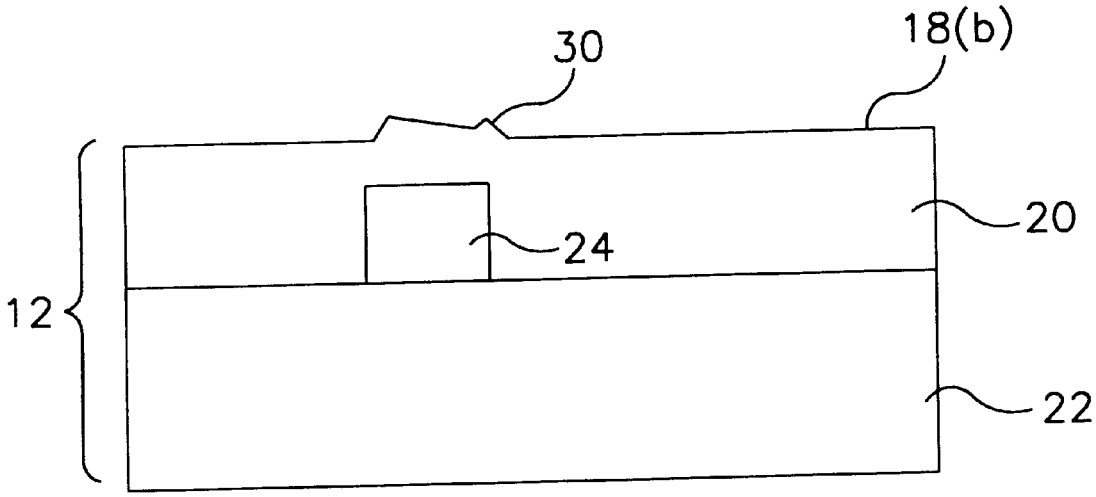
Figure 7C:
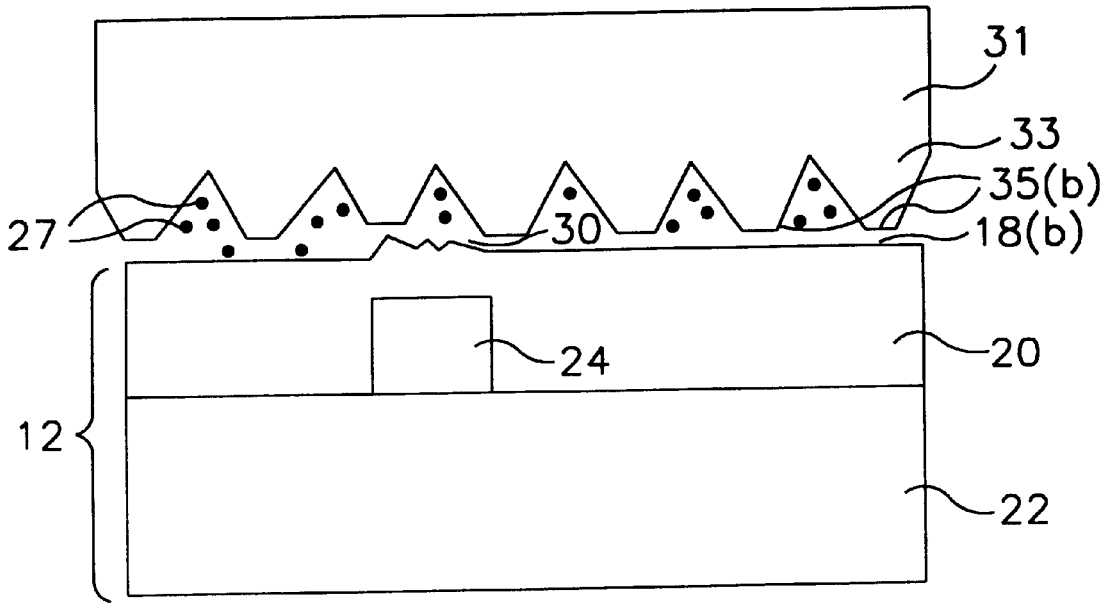
Figure 7D:
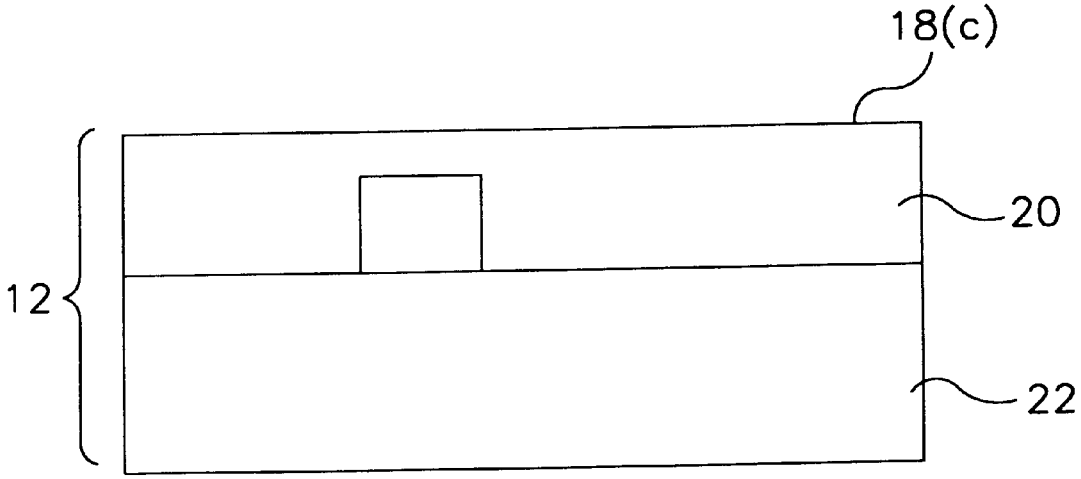

Referring now to FIGS. 5 and 6, a microreplicated surface in accordance with a preferred embodiment of the present invention suitably comprises an array of square-base regular pyramids 51. Each pyramid has a sharp distal point 53 a height h from its base. Height h and lateral dimensions a and b suitably ranges from 0.1 to 200 microns, depending on material used and desired effect. The standard deviation of h is suitably less than 5 microns. In a preferred embodiment, gradual and controlled dulling of the microreplicated structures is advantageously produced by using a three-dimensional shape whose cross-sectional area increases as it is worn away, for example, pyramids and cones rather than cubes or other parallelpipeds.

Techniques for manufacturing microreplicated surfaces are well known in the art, and typically involve molding the surface using suitable materials in conjunction with a production tool bearing an inverse array. Such production tools, which are generally metallic, can be fabricated by engraving or diamond turning. These processes are further described in *Encyclopedia of Polymer Science and Technology,* Vol. 8, John Wiley & Sons, Inc. (1968), p651–61, incorporated herein by reference. As the technology of microreplication continues to advance, finer arrays and smaller structures can be produced (see, for example, Martens, U.S. Pat. No. 4,576,850, issued March, 1986; and Yu, et al., U.S. Pat. No. 5,441,598, issued August, 1995, both incorporated herein by reference). In addition, modern silicon micromachining techniques offer a substantially more precise method of fabricating microreplicated structures. More particularly, anisotropic wet chemical etching of silicon (typically 100 and 111 orientation wafers) may be used in conjunction with standard photolithographic patterning to produce exceedingly small and regular indentations which can in turn be used as a molding form.

Referring now to FIGS. 7(*a*) and 7(*b*), substantially sharp distal points 35(*a*) of microreplicated structures 33 associated with the underside of pad 31 contact dielectric surface 18(*a*) as workpiece 12 and pad 31 are moved relative to one another. A chemically and mechanically active polishing slurry bearing abrasive particles 37 is provided between the mating surfaces of workpiece 12 and pad 31 to facilitate the planarization process. As pad 31 moves relative to workpiece 12, the distal points 35(*a*) associated with pad 31, in conjunction with the chemical effect of the polishing slurry, abrade device topographies 26, removing material from the ridges. The uniformity of the microreplicated structures leads to a concomitant uniformity in removal rate across the workpiece. In this phase—phase one of the process of the present invention—the abrasive particles 37 in the slurry do not contribute substantially to material removal rate. In particular, the sharp edges of the microreplicated surface uniformly encounter the respective leading edges 28 of ridges 26, mechanically wearing away edges 28 in conjunction with the chemical effects of the slurry. As discussed above in the context of a traditional cellular pad, abrasion occurs along edges 28 at a faster rate than other features of device topography. As a result, residual roughened undulations 30 remain proximate microstructures 24 upon completion of this phase of the process.

Referring now to FIGS. 7(*c*) and 7(*d*), as the planarization process continues, distal points 35(*b*) associated with the underside of pad 31 become substantially blunt as a result of surface ablation. At this point—phase two of the process—abrasive particles 37 begin to affect material removal rate. Specifically, as pad 31 moves relative to workpiece 12, blunt distal points 35(*b*) urge abrasive particles 37 against surface 18(*b*), thereby polishing down residual undulations 30 in accordance with the chemical and mechanical phenomena associated with the CMP process described above. This gradual blunting of the microreplicated structures in conjunction with the chemical mechanical effects of the slurry result in a more uniform planar surface 18(*c*).

Figure 8:
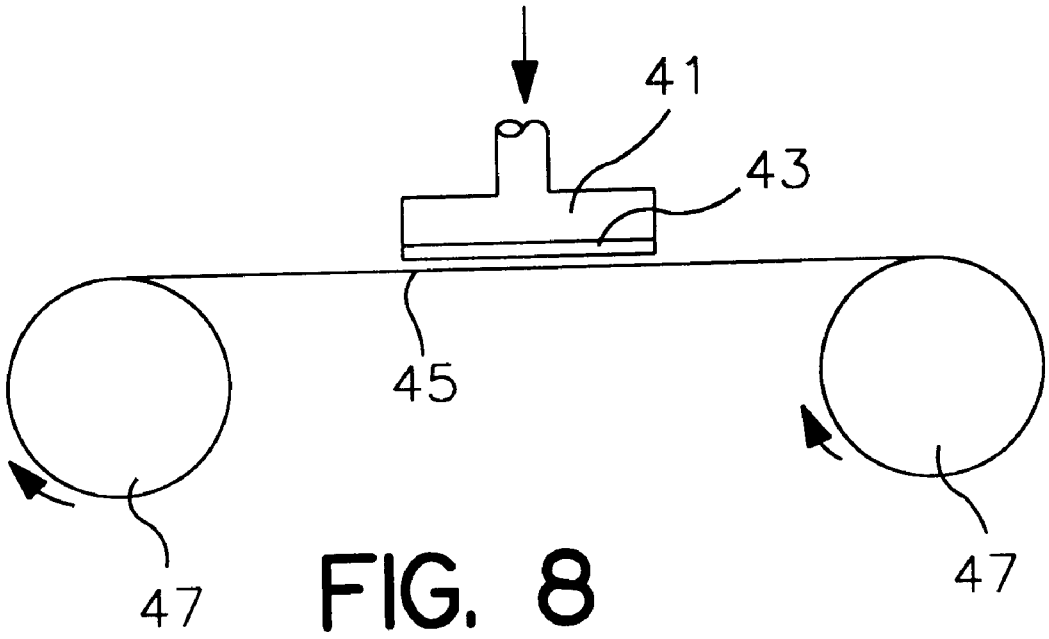
FIG. 8 is a schematic view of a preferred embodiment of the present invention utilizing a linear belt grinding/polishing apparatus incorporating a microreplicated surface.

It will be appreciated that while the preceding paragraphs discuss two discrete phases of operation, these phases are actually two broad modes of operation lying along a continuum associated with ablation level of the microreplicated surface. In view of the transitional nature of this process, and in accordance with a preferred embodiment of the present invention illustrated in FIG. 8, a microreplicated polishing surface may be advantageously incorporated into a linear belt 45. Through the use of rollers 47, belt 45 moves either continuously or, in a particularly preferred embodiment, advances linearly at the beginning of the CMP process (at the completion of the previous batch of workpieces) in order to provide a fresh section of microreplicated surface. This ensures repeatable polishing conditions, and reduces batch-to-batch variation. Workpiece 43 and holder 41 are suitably moved relative to belt 45 in a rotational, orbital, or translational mode. Optimal performance (in terms of removal rates and planarity) is then a function of a number of variables, including shape, size and density of the microreplicated structures, material properties of the microreplicated surface (hardness, homogeneity, fracture toughness), pad/workpiece movement (direction and relative speed), applied pressure, slurry particles (size, hardness, density), slurry chemistry, slurry rate, workpiece temperature, and workpiece structure.

In an alternative embodiment, a microreplicated surface is fabricated with suitable materials such that no significant ablation occurs during the CMP process. As a result, a standard circular or orbital process may be used without the requirement of providing a new microreplicated pad prior to the start of a new batch of workpieces.

It will be appreciated that, while a preferred embodiment of the present invention is illustrated herein in the context of a dielectric layer over microelectronic structures, the present invention may be useful in the context of a wide range of workpieces. For example, microreplicated pads may advantageously be utilized in processing magnetic disk material. More specifically, such surfaces require both polishing and texturizing of the metal film (typically aluminum) as well as the post-sputtered surface. Such processes benefit from the uniformity offered by microreplicated surfaces. Another example involves the photoresist process used during semiconductor device processing. Many forms of photoresist are applied using a "spin-on" procedure, wherein liquid photoresist is deposited on a spinning wafer, thereby distributing the photoresist substantially evenly over the wafer surface as a result of centrifugal force. One weakness of this method, however, is that substantial build up of photoresist may occur along the outer perimeter of the exposed photoresist layer. Microreplicated surfaces offer a means to remove this build up and increase the planarization of the wafer.

Although the present invention is set forth herein in the context of the appended drawing figures, it should be appreciated that the invention is not limited to the specific forms shown. Various other modifications, variations, and enhancements in the design and arrangement of the microreplicated pad and various process parameters discussed herein may be made in the context of the present invention. For example, a preferred embodiment of the present invention is illustrated herein in the context of a dielectric layer over microelectronic structures; however, the present invention may be useful in the context of both multilevel integrated circuits and other small electronic devices, and for fine finishing, flattening and planarization of a broad variety of chemical, electromechanical, electromagnetic, resistive and inductive resistive devices, as well as for the fine finishing, flattening and planarization of optical and electro-optical and mechanical devices. These and other modifications may be made in the design and implementation of various aspects of the invention without departing from the spirit and scope of the invention as set forth

What is claimed is:

1. A process for chemically and mechanically planarizing a workpiece having a surface, comprising the steps of:

providing a pad having a substantially sharp microreplicated surface;

applying said substantially sharp microreplicated surface under pressure to said surface of said workpiece in the presence of a polishing slurry;

relatively moving said surface of said workpiece with respect to said pad having a substantially sharp microreplicated surface along a plurality of directions within a plane defined by the contact area of said pad and workpiece surfaces;

ablating said substantially sharp microreplicated surface by relatively moving said pad with respect to said workpiece such that said microreplicated surface becomes substantially blunt; and relatively moving said surface of said workpiece with respect to said pad having a substantially blunt surface along a plurality of directions within a plane defined by the contact area of said pad and workpiece surfaces.

2. The process of claim 1, wherein said step of providing a pad comprises providing a linear belt having a plurality of sections.

3. The process of claim 2, further comprising the step of consecutively advancing said linear belt to apply a new section of said substantially sharp microreplicated surface.

4. The process of claim 2, wherein said step of providing a workpiece comprises providing an integrated circuit device.

5. The process of claim 2, wherein said step of providing a workpiece comprises providing a magnetic disk.

6. The process of claim 2, wherein said step of providing a workpiece comprises providing a workpiece having a photoresist layer.

7. The process of claim 1, wherein said microreplicated surface comprises a regular array of structures, said structures having a shape including at least one of pyramidal, conical or cube-corner.

8. The process of claim 7, wherein said step of providing a workpiece comprises providing an integrated circuit device.

9. The process of claim 7, wherein said step of providing a workpiece comprises providing a magnetic disk.

10. The process of claim 7, wherein said step of providing a workpiece comprises providing a workpiece having a photoresist layer.

11. A process for planarizing a wafer surface, comprising the steps of:

providing a microreplicated surface with a regular array of precisely shaped three-dimensional structures with sharp distal points and a holder adapted to retain the wafer;

pressing the wafer in the holder against the microreplicated surface and causing relative motion between the wafer surface and the microreplicated surface;

performing a rough planarization process by ablating the sharp structures of the microreplicated surface; and gradually entering a fine planarization process as the structures of the microreplicated surface become dull until the wafer surface has been satisfactorily planarized.

12. A process for planarizing a wafer surface, comprising the steps of:

providing a microreplicated surface with a regular array of precisely shaped three-dimensional structures with sharp distal points and a holder adapted to retain the wafer;

holding the microreplicated surface by a first and a second roller;

pressing the wafer in the holder against the microreplicated surface and causing relative motion between the wafer surface and the microreplicated surface;

performing a rough planarization process by ablating the sharp structures of the microreplicated surface; and gradually entering a fine planarization process as the structures of the microreplicated surface become dull.

13. The process of claim 12, further comprising the step of:

continuously advancing the microreplicated surface during the planarization process.

14. The process of claim 12, further comprising the step of:

advancing the microreplicated surface prior to the start of the planarization process to provide fresh microreplicated surface.

15. The process of claim 12, wherein the standard deviation of the height of the three-dimensional structures is less than 5 microns.

16. The process of claim 12, wherein the width, length and height of the three-dimensional structures are between 0.1 and 200 microns.

17. A process for planarizing a wafer surface, comprising the steps of:

providing a microreplicated surface with a regular array of precisely shaped three-dimensional structures with sharp distal points and a holder adapted to retain the wafer;

holding the microreplicated surface by a first and second roller;

pressing the wafer in the holder against the microreplicated surface and causing relative motion between the wafer surface and the microreplicated surface;

introducing a fluid adpated to enhance the planarization process between the wafer and the microreplicated surface;

performing a rough planarization process by ablating the sharp structures of the microreplicated surface; and gradually entering a fine planarization process as the structures of the microreplicated surface become dull.

18. The process of claim 17, wherein the fluid contains abrasive particles.

19. The process of claim 18, wherein the abrasive particles are between 10 and 1000 nanometers in size.

* * * * *